US009120596B2

(12) United States Patent
Dunn

(10) Patent No.: US 9,120,596 B2
(45) Date of Patent: Sep. 1, 2015

(54) PALLET

(71) Applicant: 1-P.A.L. PTY LTD, Bundoora, Melbourne, Victoria (AU)

(72) Inventor: Matthew Dunn, Melbourne (AU)

(73) Assignee: 1-P.A.L. PTY LTD (AU)

( * ) Notice: Subject to any disclaimer, the term of this patent is extended or adjusted under 35 U.S.C. 154(b) by 0 days.

(21) Appl. No.: 14/365,347

(22) PCT Filed: Dec. 7, 2012

(86) PCT No.: PCT/AU2012/001501

§ 371 (c)(1),
(2) Date: Jun. 13, 2014

(87) PCT Pub. No.: WO2013/086560

PCT Pub. Date: Mar. 20, 2013

(65) Prior Publication Data

US 2014/0345500 A1 Nov. 27, 2014

(30) Foreign Application Priority Data

Dec. 13, 2011 (AU) ..... 2011905176

(51) Int. Cl.

| | |
|---|---|
| ***B65D 19/22*** | (2006.01) |
| ***B65D 19/38*** | (2006.01) |
| ***B65D 19/00*** | (2006.01) |

(52) U.S. Cl.

CPC ..... *B65D 19/38* (2013.01); *B65D 19/0016* (2013.01); *B65D 2519/00024* (2013.01); *B65D 2519/00029* (2013.01); *B65D 2519/00034* (2013.01); *B65D 2519/00039* (2013.01); *B65D 2519/00059* (2013.01); *B65D 2519/00064* (2013.01); *B65D 2519/00069* (2013.01); *B65D 2519/00074* (2013.01); *B65D 2519/0094* (2013.01); *B65D 2519/0096* (2013.01); *B65D 2519/00268* (2013.01); *B65D 2519/00288* (2013.01); *B65D 2519/00318* (2013.01); *B65D 2519/00323* (2013.01); *B65D 2519/00333* (2013.01)

(58) Field of Classification Search

CPC ..... B65D 19/385; B65D 19/0038; B65D 2519/0094; B65D 2519/00955; B65D 2519/0096; B65D 2519/00024

USPC ..... 108/53.1, 53.3, 53.5, 57.1, 57.25, 108/57.29, 901; 206/386

See application file for complete search history.

(56) References Cited

U.S. PATENT DOCUMENTS

| | | | | |
|---|---|---|---|---|
| 1,334,409 | A * | 3/1920 | Sindelar | 108/57.29 |
| 2,420,625 | A | 5/1947 | Stalnaker et al. | |
| 3,233,564 | A * | 2/1966 | Sullivan | 108/53.1 |
| 5,667,065 | A * | 9/1997 | Fahrion | 206/599 |
| 5,823,549 | A | 10/1998 | Morgan, Jr. | |
| 6,220,183 | B1 * | 4/2001 | Schwitzky | 108/53.3 |
| 6,257,152 | B1 | 7/2001 | Liu | |
| 2009/0267313 | A1 | 10/2009 | Kalajyan | |

* cited by examiner

OTHER PUBLICATIONS

International Search Report for PCT Application No. PCT/AU2012/001501; mailed Feb. 20, 2013; 4 pages.

*Primary Examiner* — Janet M Wilkens
(74) *Attorney, Agent, or Firm* — Barclay Damon, LLP

(57) ABSTRACT

A stackable pallet (10) for use in transportation of goods and for stacking in a rotated stacking configuration with at least one second substantially same stackable pallet, the first-mentioned stackable pallet (10) including a substantially planar body (12) having an upper face (14) and a lower face (16), a plurality of substantially parallel elongate support members (18) depending from the lower face (16), a plurality of substantially parallel elongate slots (20), each slot open to at least the upper face (14).

24 Claims, 13 Drawing Sheets

PALLET

CROSS-REFERENCE TO RELATED APPLICATION

This application is a national stage application pursuant to 35 U.S.C. §371 of International Application No. PCT/AU2012/001501, filed Dec. 7, 2012, which claims priority upon Australian Patent Application No. 2011905176, filed Dec. 13, 2011, the entire contents of each application herein being incorporated by reference.

FIELD OF THE INVENTION

The present invention relates to a pallet. The pallet may be particularly useful for transportation of goods by sea, land and/or air.

BACKGROUND OF THE INVENTION AND PRIOR ART

Presently, pallets are used for transportation of goods by various forms of transport. There are many different designs for such pallets, and the designs are usually suited to a specific industry or commercial need. This has resulted in a number of different designs, types and dimensions for pallets used in the various industries.

Typically, a pallet consists of two decks, one upper deck to carry the weight of the goods to be transported, and a lower deck, which provides structural support. Such a pallet may also include beams located between the two decks for further strengthening the pallet.

Due to the non-uniform design, with different shapes and sizes, there has been a problem with loading and/or unloading of pallets, along with problems in transportation and storage of the pallets and the transported goods. Pallets with upper and lower decks cannot be efficiently transported in bulk when empty, due to bulkiness of the stacked pallets. Further, many pallets (including wooden pallets) are designed to be used as one-way pallets, wherein such pallets are generally not returned to their point of origin. Such pallets are often destroyed after being used for only a few trips to transport goods.

The logistics of returning used pallets has become a concern in the transport industry. Using pallets once, or only a few times, is inefficient, wasteful and costly. Furthermore, inefficient handling of pallets leads to further costs and wastage.

Plastic pallets have been used in order to overcome some of the associated problems. Such plastic pallets may have a longer life. Further, due to the large volumes of pallet movement within retail, fast moving consumer goods and export markets, plastic pallets may provide superior functionality when compared with other pallets (for example, wooden pallets). Plastic pallets may mitigate inefficiencies and reduce costs associated with return logistics, whilst having the required functionality of a pallet for transporting goods.

It is an object of the present invention to overcome, or at least ameliorate, one or more of the above-mentioned problems. The present invention may also overcome, or at least ameliorate, other problems in the prior art.

SUMMARY OF THE INVENTION

Accordingly, in one aspect, the present invention provides a stackable pallet for use in transportation of goods and for stacking in a rotated stacking configuration with at least one second substantially same stackable pallet, the first-mentioned stackable pallet including, a substantially planar body having an upper face and a lower face, a plurality of substantially parallel elongate support members depending from the lower face, a plurality of substantially parallel elongate slots, each slot open to at least the upper face, wherein the longitudinal axis of the slots are substantially orthogonal to the longitudinal axis of the support members, and wherein each slot is configured to receive a respective one of the plurality of support members of the second stackable pallet, such that, when stacking the second pallet on to the first-mentioned pallet in the rotated stacking configuration, the support members and slots of the second pallet are, respectively, substantially orthogonal to the support members and slots of the first-mentioned pallet.

In another aspect, the present invention provides a method of transporting goods, wherein the goods are located on a stackable pallet, the pallet including a substantially planar body having an upper face and a lower face, a plurality of substantially parallel elongate support members depending from the lower face, a plurality of substantially parallel elongate slots, each slot open to at least the upper face, wherein the longitudinal axis of the slots are substantially orthogonal to the longitudinal axis of the support members, and wherein each slot is configured to receive a respective one of the plurality of support members of the second stackable pallet, such that, when stacking the second pallet on to the first-mentioned pallet in the rotated stacking configuration, the support members and slots of the second pallet are, respectively, substantially orthogonal to the support members and slots of the first-mentioned pallet.

SUMMARY OF OPTIONAL EMBODIMENTS OF THE INVENTION

In an embodiment, each slot is configured to allow substantially the whole of each of the plurality of support members of the second stackable pallet to pass through the upper face opening of each respective slot when stacking the second pallet on to the first-mentioned pallet in the rotated stacking configuration, such that, when stacked, the lower face of the second pallet is adjacent or very near the upper face of the first-mentioned pallet.

In another embodiment, the slots are through the body, such that each slot is further open to the lower face, and wherein each slot is configured to allow a lower portion of each of the plurality of support members of the second stackable pallet to pass through the lower face opening when stacking the second pallet on to the first-mentioned pallet in the rotated stacking configuration.

In a further embodiment, the pallet includes an upper recess corresponding to where each slot intersects with each support member, each upper recess located in an upper portion of the respective support member and being open to the respective slot, such that, when stacking the second pallet on to the first-mentioned pallet in the rotated stacking configuration, a part of the lower portion of the respective one of the plurality of support members of the second stackable pallet is received in a respective upper recess of the first-mentioned pallet.

In yet another embodiment, the pallet includes a lower recess corresponding to where each slot intersects with each support member, each lower recess located in the lower portion of the respective support member and being open to a bottom face of the respective support member, such that, when stacking the second pallet on to the first-mentioned pallet in the rotated stacking configuration, a part of an upper portion of the respective one of the plurality of support members of the first-mentioned pallet is received in a respective lower recess of the second pallet.

In yet a further embodiment, the pallet includes a lower recess corresponding to each upper recess in the respective support member, and located below the corresponding upper recess, the lower recess located in the lower portion of the respective support member and being open to a bottom face of the respective support member, such that, when stacking the second pallet on to the first-mentioned pallet in the rotated stacking configuration, an upper recess of the first-mentioned pallet and a respective lower recess of the second pallet receive each other.

In an optional embodiment, each support member includes hollow sections.

In another optional embodiment, at least some of the hollow sections are open to the upper face.

In a further optional embodiment at least some of the hollow sections are open to the bottom face of the respective support member.

In yet another optional embodiment, the support members are configured such that tines of a fork lift device are able to be inserted beneath the lower face so as to be between and in a first direction substantially parallel to the support members, and the tines are not able to be inserted in a direction substantially other than the first direction.

In yet a further optional embodiment, the pallet is adapted to be used with a first type rack having parallel bars with a first separation between the bars, such that, when the pallet is located on the first type rack, the support members are substantially orthogonal to the bars and are configured such that a section of each support member is in contact with each bar.

In an embodiment, each support member has a height sufficient to allow tines of a fork lift device to be inserted beneath the lower face when the pallet is located on the first type rack.

In another embodiment, each section includes a rack recess in the respective support member, such that, when the pallet is located on the first type rack, each bar inserts in to a plurality of respective rack recesses, such that the pallet is prevented from sliding orthogonally with respect to the bars.

In a further embodiment, each rack recess is sufficiently shallow to allow tines of a fork lift to be inserted beneath the lower face when the pallet is located on the first type rack.

In yet another embodiment, each rack recess is at least partly co-located with a lower recess.

In yet another embodiment, the pallet is adapted to be used with a second type rack having parallel bars with a second separation between the bars, such that, when the pallet is located on the second type rack, the support members are substantially parallel to the bars and parts of the lower face is in contact with each bar, each part being at or close to an edge of the body.

In yet a further embodiment, the first separation is less than the second separation.

In an optional embodiment, the plurality of support members includes, adjacently, a first, a second, a third and a fourth support member.

In an embodiment, the first and the fourth support members are located close to and parallel to respective outside edges of the body and the second and the third support member are located close to and parallel to a centre line of the body, such that a first and a second tine of a fork lift device are able to be inserted, respectively, between the first and second, and between the third and fourth support members.

In an optional embodiment, the pallet has a pallet height, wherein, when the second pallet is stacked on to the first-mentioned pallet in the rotated stacking configuration, the stacked pallets have a sum height less than twice the pallet height.

In an embodiment, the pallet further includes a plurality of substantially parallel elongate channels in the upper face to allow for stacking in a non-rotated stacking configuration, wherein the longitudinal axis of the channels are substantially parallel to the longitudinal axis of the support members, and wherein each channel is configured to receive a respective one of a plurality of support members of the second stackable pallet, such that, when stacking the second pallet on to the first-mentioned pallet in the non-rotated stacking configuration, the support members and channels of the second pallet are substantially parallel to the support members and channels of the first-mentioned pallet.

In an optional embodiment, each support member is configured to be sufficiently high and each channel is configured to be sufficiently shallow, such that, when the second pallet is stacked on to the first-mentioned pallet in the non-rotated stacking configuration, tines of a fork lift device are allowed to be inserted between the lower face of the second pallet and the upper face of the first-mentioned pallet.

In yet another embodiment, each channel includes a plurality of channel sections, each channel section separated from an adjacent channel section where the channel intersects a slot.

BRIEF DESCRIPTION OF THE DRAWINGS

One or more embodiments of the invention are described below with reference to the accompanying drawings, which are incorporated in and constitute a part of this specification. In the drawings.

DETAILED DESCRIPTION OF EMBODIMENTS OF THE INVENTION

Figure 1:
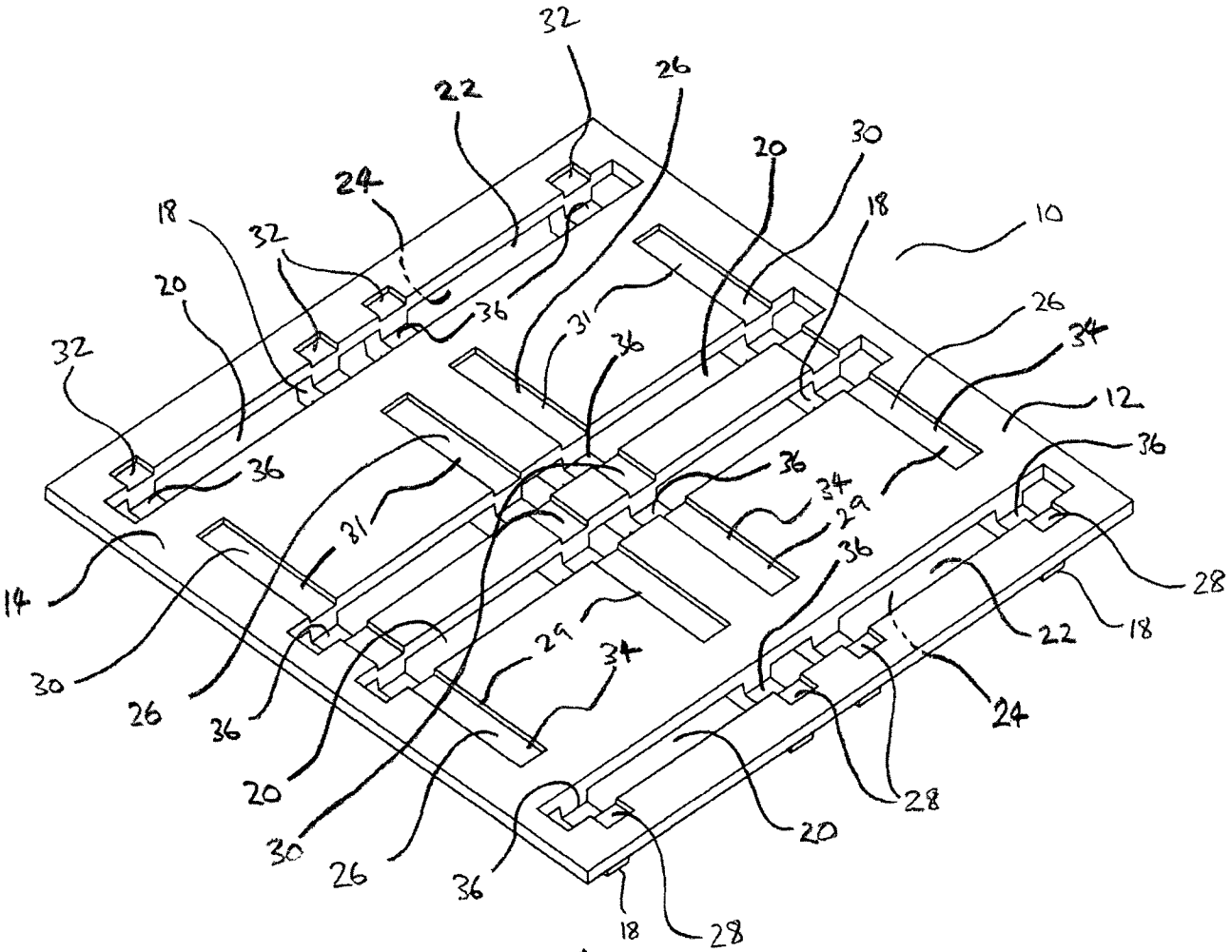
FIG. 1 is a top perspective view of a pallet according to an embodiment of the present invention.

Referring to FIG. 1, there is shown a top perspective view of a pallet 10 in accordance with an embodiment of the present invention. The pallet 10 has a planar body 12, the body having an upper face 14 and a lower face 16. The pallet has four elongate parallel support members 18, depending from the lower face 16 (the support members 18 are better shown in FIG. 2).

The pallet 10 also includes four parallel elongate slots 20, each slot being open to the upper face 14 and open to the lower face 16 of the body 12 of the pallet 10.

Each slot 20 is sized and shaped so as to be able to receive a corresponding support member 18*a* of a second pallet 10*a*, being substantially same as the pallet 10 shown in FIG. 1 (refer to FIGS. 7 to 16 to view second substantially same pallet).

In the embodiment shown in FIG. 1, due to the slots 20 having an opening 22 in the upper face and an opening 24 in the lower face, support members 18*a* of the second pallet 10*a* are able to pass completely through a respective slot 20 in the first-mentioned pallet 10.

The pallet 10 also includes channels 26, which run orthogonal to the slots 20, and parallel to the support members 18. Each channel 26 is located in the body 12 of the pallet 10 above a respective support member 18. The channels 26 are open to the upper face 14 of the pallet 10.

Due to the size and shape of the opening 34 of each channel 26 in the upper face 14, and due to the shape and size of each channel 26, support members 18*a* of the second pallet 10*a* are able to fit into a respective channel 26 in the pallet 10 (refer to FIGS. 7 to 16).

When stacking a second pallet 10*a* on the first mentioned pallet 10, there are two optional stacking configurations. A first stacking configuration (rotated stacking configuration) is used when it is desired to stack the pallets so as to be maximally compact. When stacking the pallets 10, 10*a* in the rotated stacking configuration, the second pallet 10*a* is rotated around 90° with respect to the first-mentioned pallet 10, such that the support members 18*a* of the second pallet 10*a* are inserted into the slots 20 of the first-mentioned pallet 10.

In a second stacking configuration (non-rotated stacking configuration), the pallets 10, 10*a* are stacked in a way which leaves at least a substantial gap between the pallets. In this non-rotated stacking configuration, the pallets are not maximally compact when stacked, however, due to the gap between the pallets, a user can operate a lifting device, such as a forklift (refer to FIG. 21) in order to lift the second pallet 10*a* from the first-mentioned pallet 10.

In order to stack the second pallet 10*a* on to the first-mentioned pallet 10 in the non-rotated stacking configuration, the second pallet is orientated in the same direction as the first-mentioned pallet, such that support members 18*a* of the second pallet 10*a* are parallel with support members 18 of the first-mentioned pallet 10. The second pallet is lowered onto the first pallet so that the support members 18*a* of the second pallet are inserted into the channels 26 of first-mentioned pallet.

The channels 26 are sufficiently shallow so that the support members 18*a* of the second pallet 10*a* protrude above the upper surface 14 of the first-mentioned pallet 10, when the second pallet is stacked in the non-rotated stacking configuration on the first-mentioned pallet.

Also shown in FIG. 1, each support member 18 has four upper recesses 36, each upper recess located in an upper portion 40 of the respective support member 18. The upper recesses are located in positions corresponding to where the respective support member 18 intersects with one of the four slots 20, the four slots being orthogonal to the support members.

The upper recesses 36 are open through the body 12 of the pallet 10 to the upper face 14. When the second pallet 10*a* is stacked in the rotated stacking configuration on the first-mentioned pallet 10, the support members 18*a* of the second pallet 10*a* are inserted through the slots 20 of the first-mentioned pallet 10, and each support member 18*a* is received into its four respective upper recesses 36, each of the four respective recesses being in one of the four support members 18 of the first-mentioned pallet 10.

Figure 2:
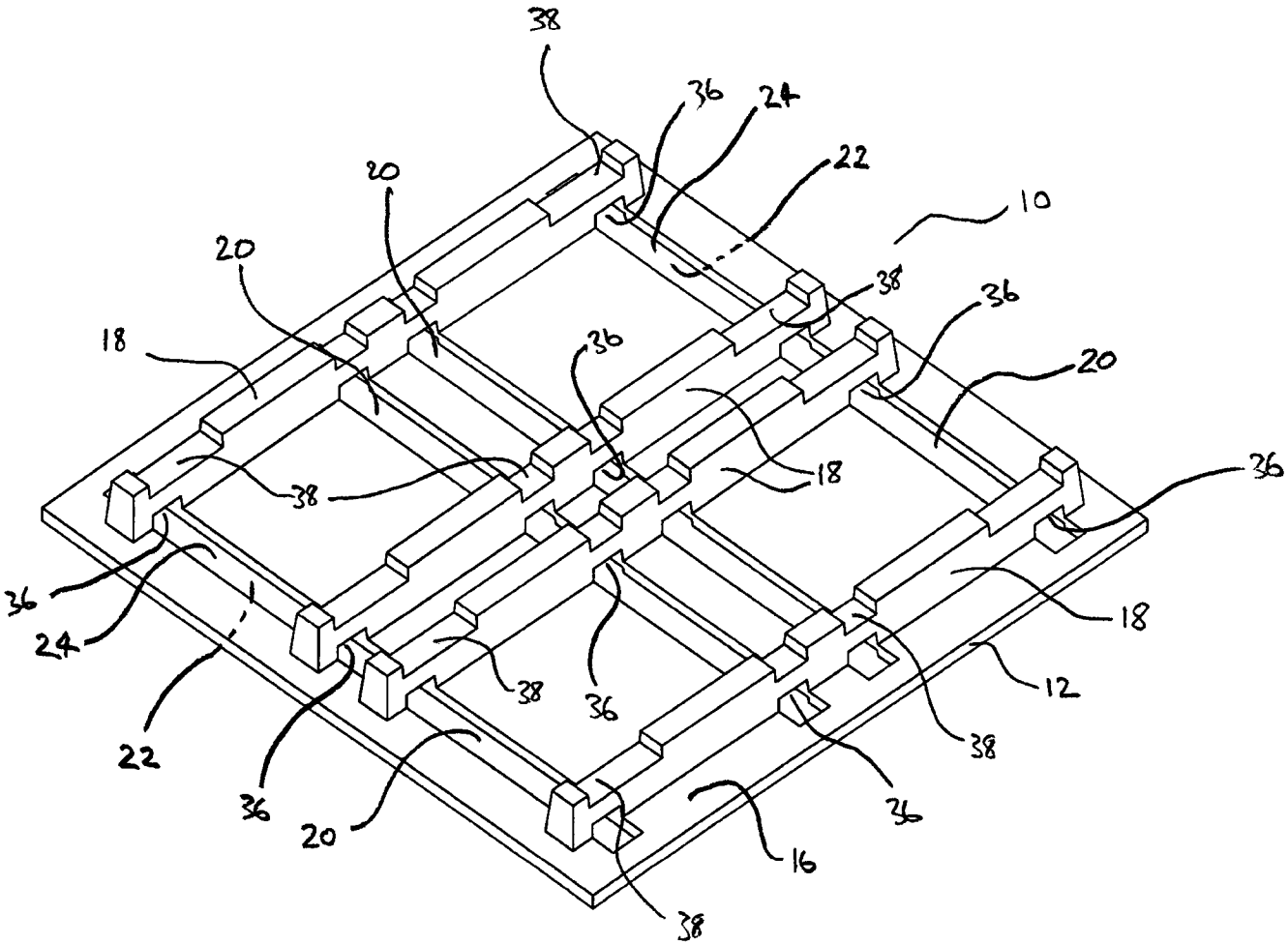
FIG. 2. is a bottom perspective view of the pallet as shown in FIG. 1.

With respect to FIG. 2, the pallet 10 is shown from a bottom perspective view, so as to be able to better see features on an underside of the pallet. As can be more clearly seen in this view, each support member also includes four lower recesses 38. Each lower recess 38 corresponding with an upper recess 36, whereby the lower recess 38 is located below the respective upper recess 36 (of course, given FIG. 2 is a bottom perspective view, in this drawing the lower recesses 38 are shown as being above the upper recesses 36).

The lower recesses 38 are located in a lower portion 42 of the support members 18. The lower recesses are configured such that, when stacking the second pallet 10*a* onto the first-mentioned pallet 10 in the rotated stacking configuration, the lower recesses 38*a* of the second pallet 10*a* and respective upper recesses 36 of the first-mentioned pallet 10 receive each other.

Figure 3:
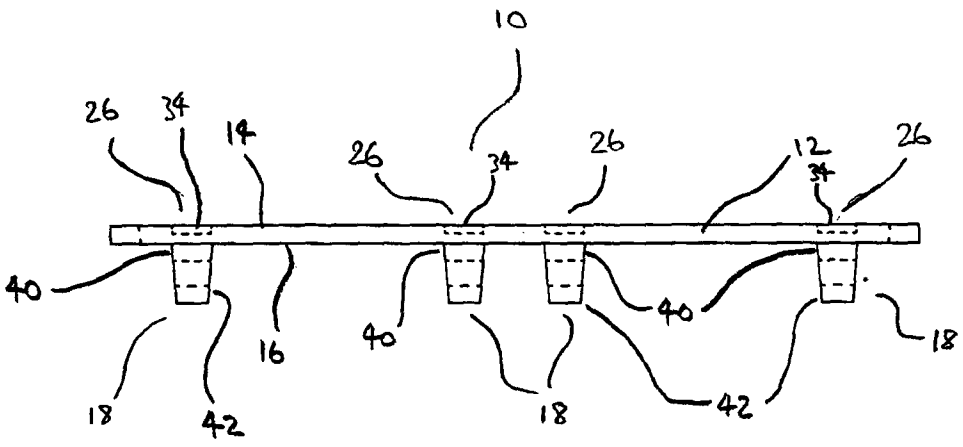
FIG. 3 is a front elevation view of the pallet as shown in FIG. 1.

FIG. 3 is a front elevation view of the pallet 10. As can be more clearly seen in FIG. 3, each support member 18 includes an upper portion 40 and a lower portion 42. Upper recesses 36 are located in the upper portion 40 and lower recesses 38 are located in the lower portion 42.

Figure 4:
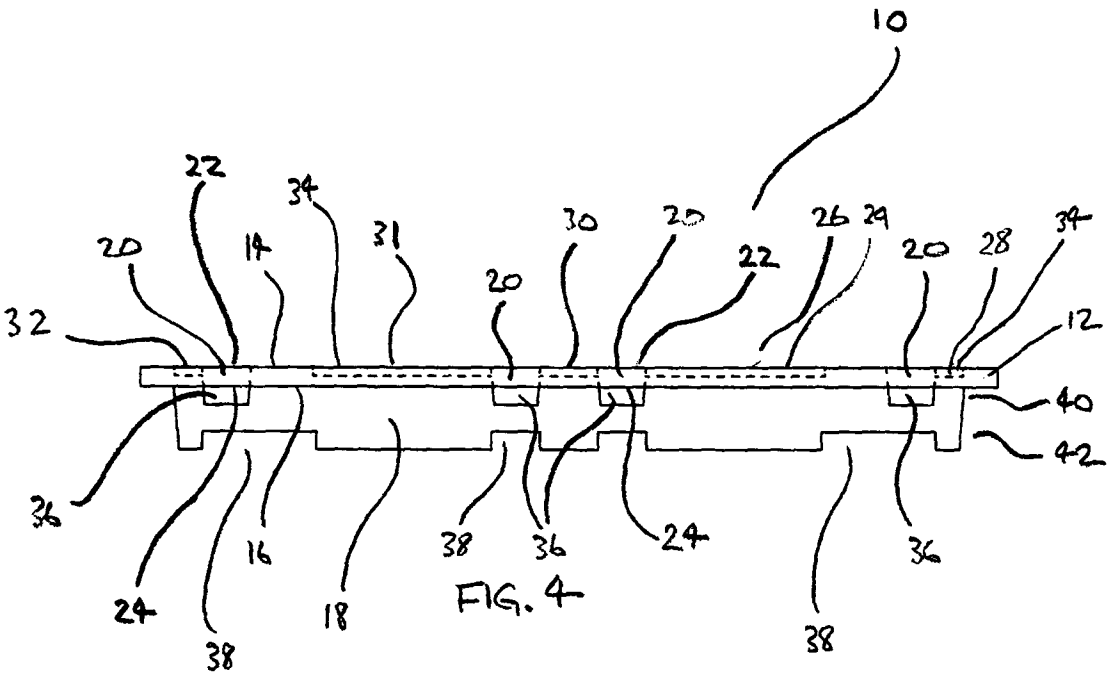
FIG. 4. is a side elevation view of the pallet as shown in FIG. 1.

FIG. 4 is a side elevation view of the pallet 10. As can be more-clearly seen in FIG. 4, there are four lower recesses 38, each corresponding with an upper recess 36. However, the two outer-most lower recesses are wider than the two inner-most lower recesses. The two outer-most recesses are wider so as to be able to rest on beams of a standard beam racking system (refer to FIGS. 19 and 20).

As can also be clearly seen in FIG. 4, the lower recesses 38 are open to a bottom face of the support member 18.

Figure 5:
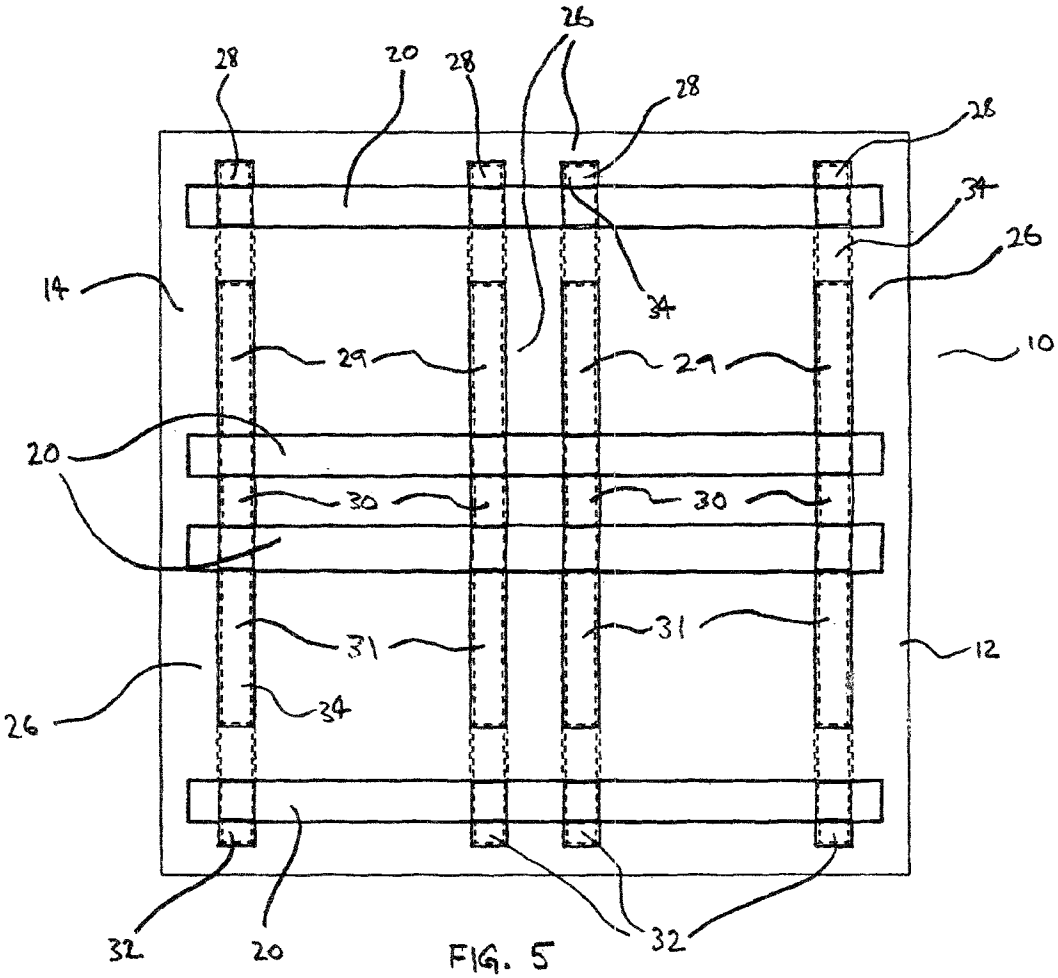
FIG. 5 is a top plan view of the pallet as shown in FIG. 1.

FIG. 5 shows a top plan view of the pallet 10. In this view, it can be seen that the channels 26 include five channel sections, 28, 29, 30, 31, and 32. Each channel section is separated from its adjacent channel section by intersection of the respective channel 26 with one of the four slots 20. In this way, each channel 26 includes two outer channel sections 28 and 32, the outer channel sections are located between the outer most slots and edges of the body 12 of the pallet 10. The centre channel section of each channel 26 is located between the two inner most slots 20. Further, intermediate channel sections 29, 31 of each channel 26 are located between a respective inner slot and outer slot 20.

Figure 6:
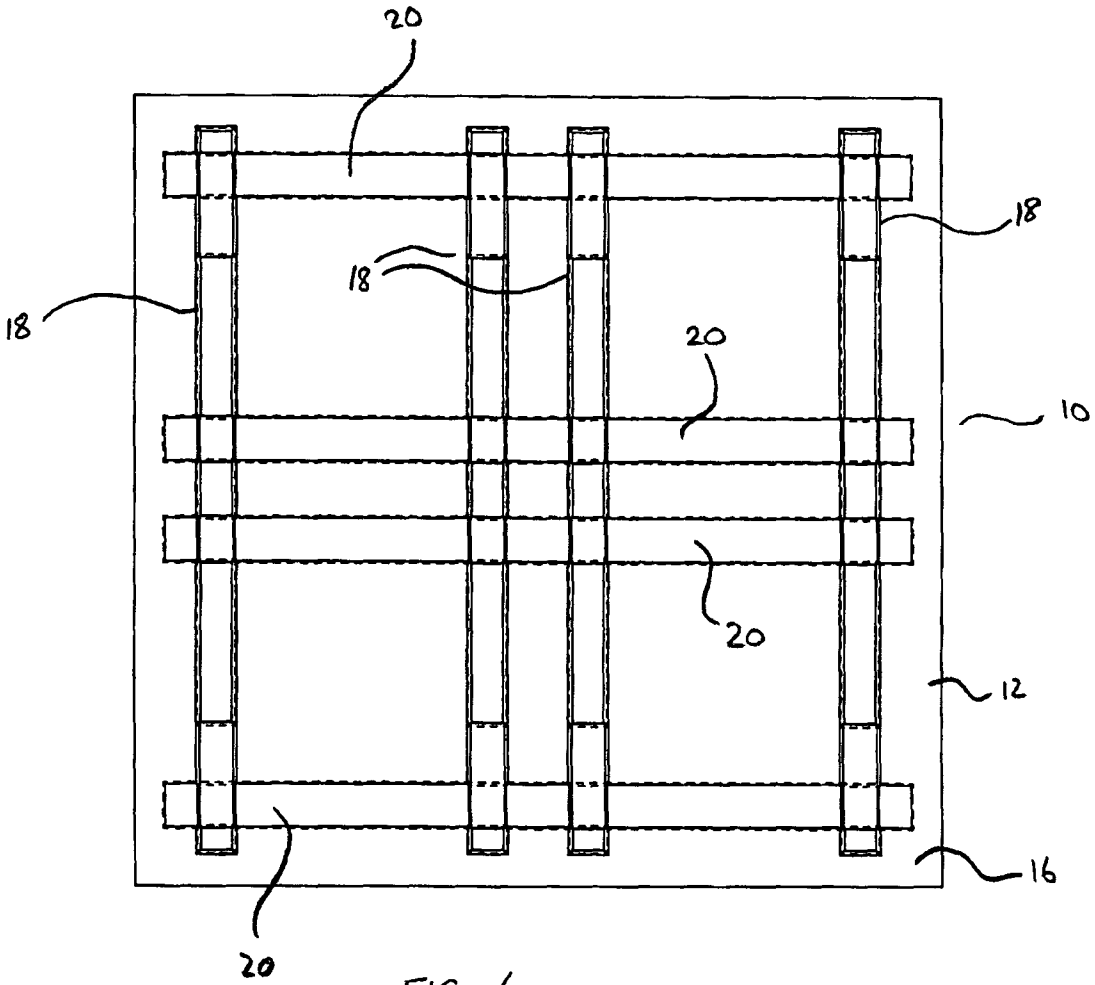
FIG. 6 is a bottom plan view of the pallet as shown in FIG. 1.

FIG. 6 is a top plan view of the pallet 10.

Figures 7, 8, 9, 10, 11:
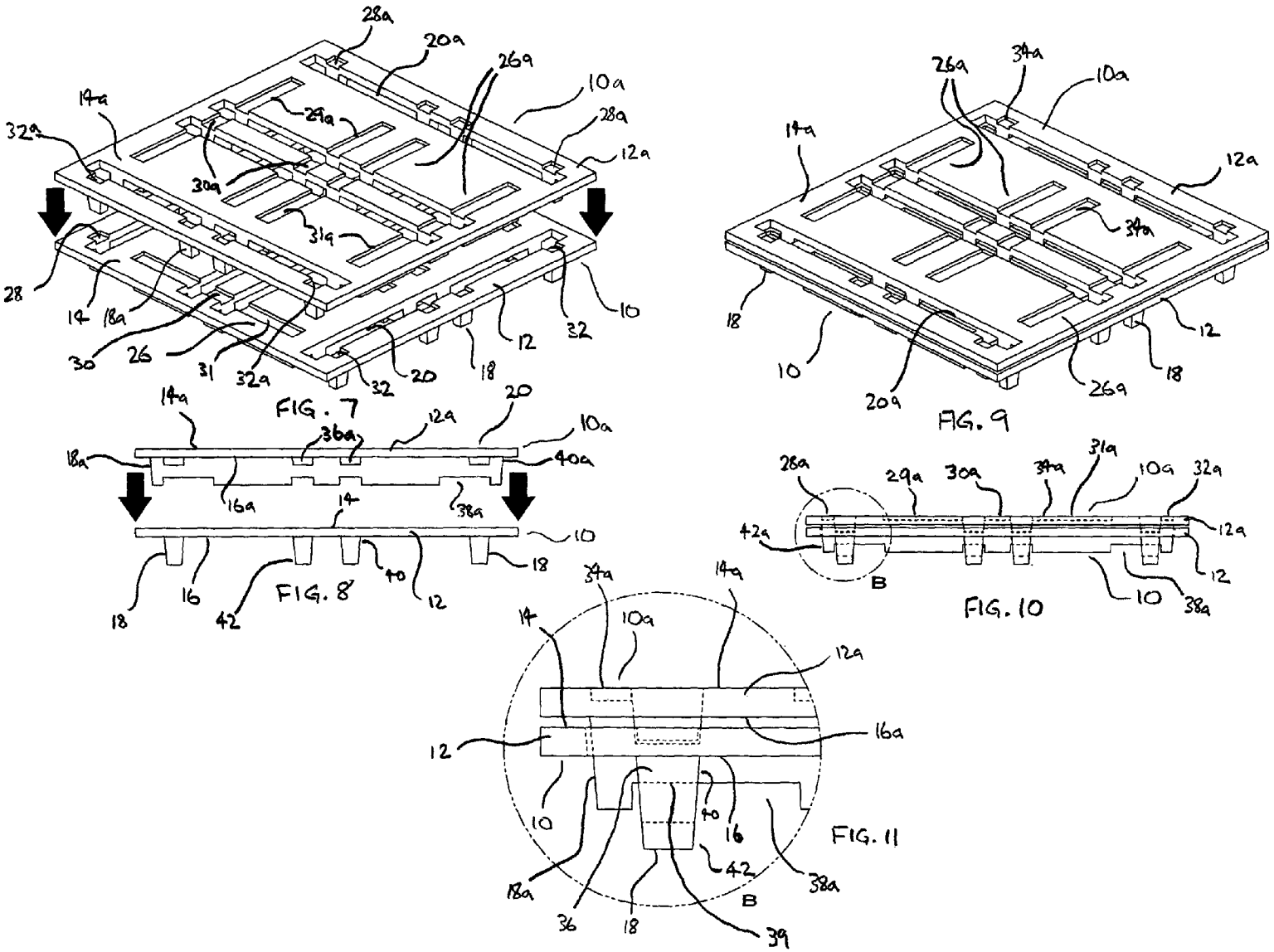
FIG. 7 is a top perspective view of two pallets according to the embodiment shown in FIG. 1, one pallet being stacked onto the other pallet in a rotated stacking configuration.
FIG. 8 is a front elevation view (with respect to the bottom-most pallet) of the pallets being stacked in a rotated stacking configuration, as shown in FIG. 7.
FIG. 9 is a top perspective view of the pallets in FIGS. 7 and 8, showing the pallet when stacked in the rotated stacking configuration.
FIG. 10 is a front elevation view (with respect to the bottom-most pallet) of the pallets when stacked in a rotated stacking configuration, as shown in FIG. 9.
FIG. 11 shows a detail of FIG. 10, within the dotted and dashed circle B.

FIGS. 7, 8, 9, 10 and 11 show steps in the process of stacking two pallets, in accordance with an embodiment of the present invention, wherein the stacking is a rotated stacking configuration. In this regard, the pallets 10, 10*a* are rotated 90° with respect to each other. In FIG. 7, the first-mentioned pallet 10 is on the bottom of the stack and the second pallet 10*a* is stacked onto the first-mentioned pallet. The black arrows pointing downwardly show the direction of stacking the second pallet onto the first-mentioned pallet.

The support members 18*a* of the second pallet 10*a* fit into the slots 20 of the first-mentioned pallet 10. In the shown embodiment, the slots are open to the lower face 16 of pallet 10, such that the support members 18*a* of the second pallet 10*a* go through the slots 20.

When stacking the second pallet 10*a* onto the first-mentioned pallet 10 in the rotated stacking configuration, the support members 18*a* and slots 20*a* of the second pallet 10*a* are, respectively, substantially orthogonal to the support members 18 and slots 20 of the first-mentioned pallet 10.

When the second pallet 10*a* is moved downwardly such that the support members 18*a* insert through the slots 20 of the first-mentioned pallet 10, the lower recesses 38*a* of the second pallet and the upper recesses 36 of the first-mentioned pallet 10 receive each other. In this way, when the rotated stacking action is completed, the face of the lower recess 38*a* of the second pallet rests on the face of the upper recess 36 of the first-mentioned pallet. In this way, when stacked, the second pallet is supported on the first-mentioned pallet at 16 contact points.

Of course, it will be readily apparent to a person skilled in the art that it is possible to vary the number of support members, along with the number of slots. For example, it would be possible to have a pallet with six slots and support members, thus increasing the number of contact points for supporting a second pallet on top of a first pallet in the rotated stacking configuration.

It will also be clear that it is possible to stack a number of pallets together. Once the second pallet 10*a* is stacked in the rotated stacking configuration on top of the first-mentioned pallet 10, it would then be possible to stack a further pallet (not shown) on top of the stacked first-mentioned pallet 10 and second pallet 10*a*. The further pallet (not shown) would be rotated 90° with respect to the second pallet, and in this way would be oriented in the same direction as the first-mentioned pallet. Support members of the further pallet would insert into slots 20*a* of the second pallet 10*a*. Such stacking using the rotated stacking configuration can continue with even further pallets (also not shown), with each next stacked pallet being rotated 90° with respect to the pallet on which it is being stacked.

FIGS. 9, 10 and 11 show the second pallet 10*a* stacked onto the first pallet 10 in the rotated stacking configuration, where the stacking process is completed. As can be seen in each of FIGS. 9, 10 and 11, there is a small gap between the body 12*a* of the second pallet 10*a* and the body 12 of the first-mentioned pallet 10.

FIG. 11 shows a detail from FIG. 10 marked by the dotted and dashed circle B. The gap between the bodies of the stacked pallets can be more clearly seen as a gap between the lower face 16*a* of the second pallet 10*a* and the upper face 14 of the first-mentioned pallet 10.

Also shown in more detail in FIG. 11 is one of the lower recesses 38*a* of the second pallet 10*a* and one of the upper recesses 36 of the first-mentioned pallet 10 receiving each other. The dotted line 39 in FIG. 11 shows where the face of the lower recess 38*a* contacts the face of the upper recess 36.

It is possible to form the slots 20 and the support members 18 of each pallet such that when stacking the pallets in the rotated stacking configuration, at least a part of each support member fits tightly into at least a part of each respective slot. Alternatively, it is possible to form the pallets such that at least a part of each support member fits tightly into a respective upper recess of a pallet. In this way, such tight fitting components of the pallets provide more stability for a stack of pallets when stacked in the rotated stacking configuration.

As can be seen, perhaps best, in FIG. 10, when the pallets 10, 10*a* are stacked in the rotated stacking configuration, the height of the stacked pallets is considerably less than twice the height of a single pallet. Of course, if the pallets were not stacked in the rotated stacking configuration, and one pallet were to be merely stacked on top of the other, without any insertion of support members into slots, the sum height of the stacked pallets would be twice the height of a single pallet. Accordingly, using the rotated stacking configuration provided by the present invention, enables a more compact stacking, which, in turn, allows for more efficient transport of the pallets when not used for transporting goods. Consequently, where there is a need or desire to return pallets to their origin, when such pallet are stacked in the rotated stacking configuration, far less space will be required for such return transport.

FIGS. 12, 13, 14, 15 and 16 show steps in a process of stacking the pallets 10 and 10*a* in a non-rotated stacking configuration. The non-rotated stacking configuration is less compact than the rotated stacking configuration shown in FIGS. 7, 8, 9, 10 and 11, however, an advantage of the non-rotated stacking configuration is that a larger gap is left between the body 12*a* of the second pallet 10*a* and the body 12 of the first-mentioned pallet 10. Such gap may be large enough so that tines of a forklift device can be inserted into the gap where it is needed or desired to lift the second pallet 10*a* from the first-mentioned pallet 10. For example, if there were goods located on the second pallet 10*a* whilst the second pallet was stacked in the non-rotated configuration onto the first-mentioned pallet 10, the forklift device may be needed for moving the second pallet.

As can be seen in FIGS. 12, 13, 14, 15 and 16, the second pallet 10*a* is oriented in the same direction as the first-mentioned pallet 10, such that the longitudinal axis of the support members 18, 18*a* of both pallets 10, 10*a* are parallel to each other. Similarly, the slots 20, 20*a* of both pallets are parallel to each other.

When stacking the second pallet 10*a* onto the first-mentioned pallet 10 in the non-rotated stacking configuration, the support members 18*a* of the second pallet are lowered into the channels 26 of the first-mentioned pallet. Black arrows in FIGS. 12 and 13 show the direction of movement of the second pallet 10*a* towards the first-mentioned pallet 10.

The channels 26 of the first-mentioned pallet 10 each include five channel sections 28, 29, 30, 31 and 32. As can be seen in FIG. 12 (and other Figures in the specification), the support members 18*a* of the second pallet 10*a* have five bottom face sections, formed as a result of the lower recesses 38*a* being in the lower portion 42*a* of the second pallet 10*a*. Of course, the first-mentioned pallet 10 is also configured this way.

The five sections of the bottom face of each support member rest on a respective channel section of the channel 26. In this way, when the second pallet is stacked onto the first-mentioned pallet in the non-rotated stacking configuration, there are twenty points of contact providing support for the second pallet on the first-mentioned pallet. The number of support points allow for the second pallet to be loaded with goods when stacked on to the first-mentioned pallet in the non-rotated stacking configuration, such that the goods are supported by the second pallet and, in turn, by the first-mentioned pallet.

Figures 12, 13, 14, 15, 16:
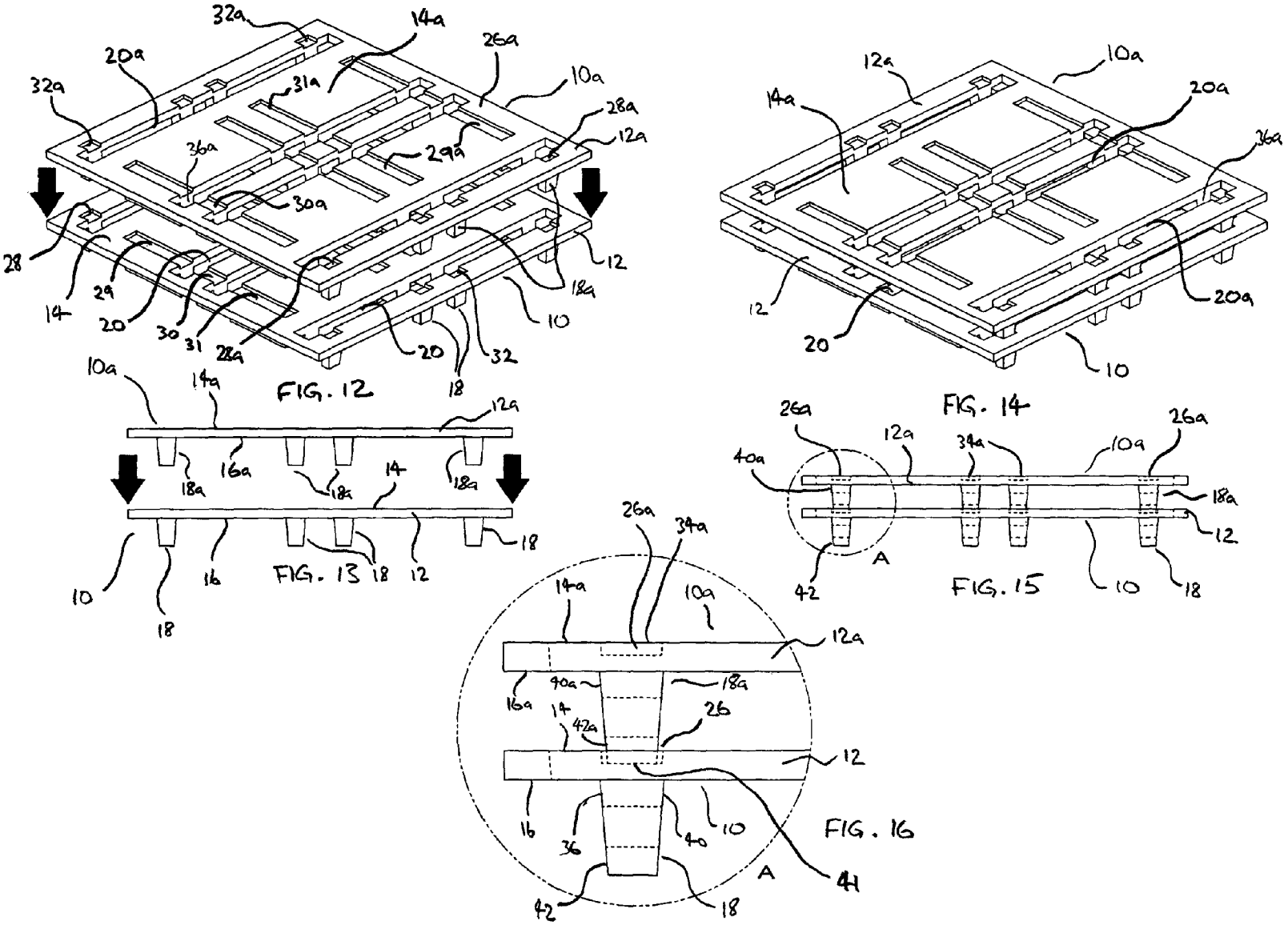
FIG. 12 is a top perspective view of two pallets according to the embodiment shown in FIG. 1, one pallet being stacked onto the other pallet in a non-rotated stacking configuration.
FIG. 13 is a front elevation view of the non-rotated stacking, as shown in FIG. 12.
FIG. 14 is a top perspective view of the pallets, as shown in FIGS. 12 and 13, when stacked in the non-rotated stacking configuration, and wherein the stacking is complete.
FIG. 15 is a front elevation view of the stacked pallets, as shown in FIG. 14.
FIG. 16 shows a detail of FIG. 15 marked within the dotted and dashed circle A.

FIG. 16 shows a detail from FIG. 15 as marked by dotted and dashed circle A. Dotted line 41 in FIG. 16 shows a point of contact wherein the bottom face of a support member 18*a* of the second pallet 10*a* rests on a face in the respective channel 26 of the first-mentioned pallet 10.

In further possible embodiments, the channels and support members of the pallets may be formed such that, when stacked in the non-rotated stacking configuration, at least a part of each support member of a top-most stacked fits tightly into a respective channel of a bottom-most stacked pallet, such that the pallets are "locked" together. The locking of the pallets together can provide further stability when the pallets are stacked in the non-rotated stacking configuration.

Figure 17:
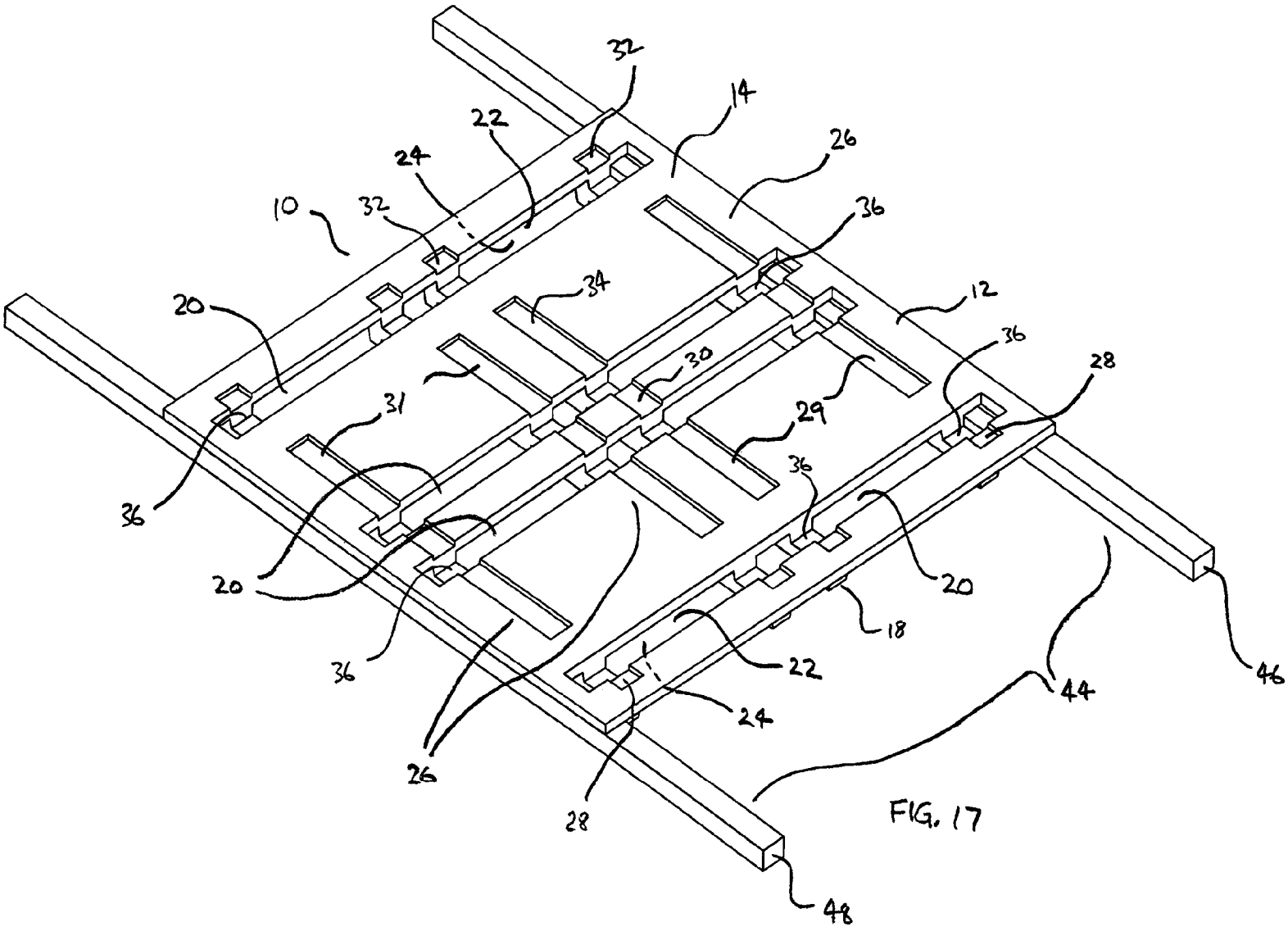
FIG. 17 is a top perspective view of a pallet in accordance with an embodiment of the present invention, the pallet resting on beams of a drive-in racking system (second type rack)
Figure 18:
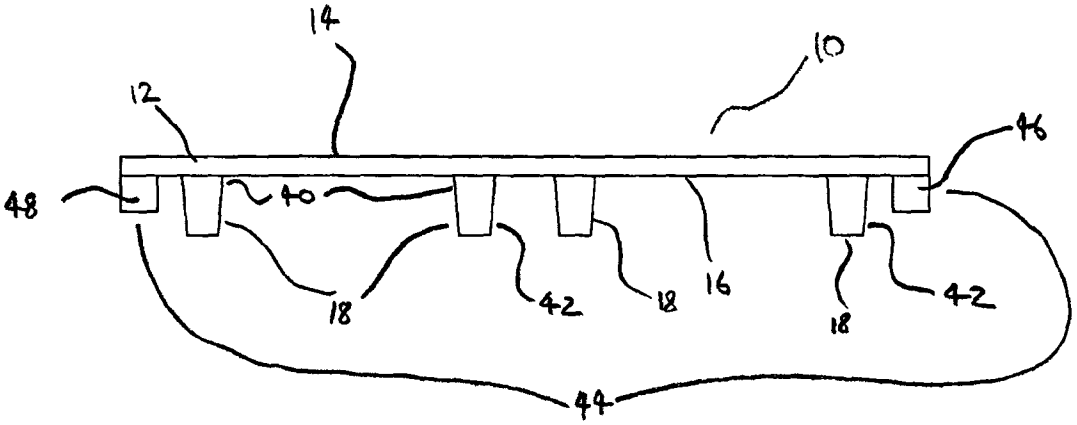
FIG. 18 is a front elevation view of the pallet on the racking system as shown in FIG. 17.

FIGS. 17 and 18 show a possible application of pallet 10, in accordance with an embodiment of the present invention, where such pallet is used with a drive-in racking system 44. In drive-in racking systems, the first beam 46 and the second beam 48 of the rack are separated by a distance such that, when placing a pallet on to the rack, the beams support the pallet at or close to opposite edges of the body 12 of the pallet 10. In this way, upper faces of the beams 46, 48 contact a part of the lower face 16, of the pallet 10. Further, support members 18, which are located towards the edges of the body 12 are, respectively, adjacent the rack beams 46 and 48.

It is possible to form the pallet 10 such that the two outermost support members 18 substantially prevent or ameliorate movement of the pallet in a direction which is orthogonal with respect to the beams. By preventing or ameliorating such orthogonal movement, the positioning of the outer-most support members 18 may ensure that the pallet 10 cannot be readily dismounted from the drive-in racking system.

For the purposes of this specification, the drive-in racking system may be described or defined as a "second type rack".

Figure 19:
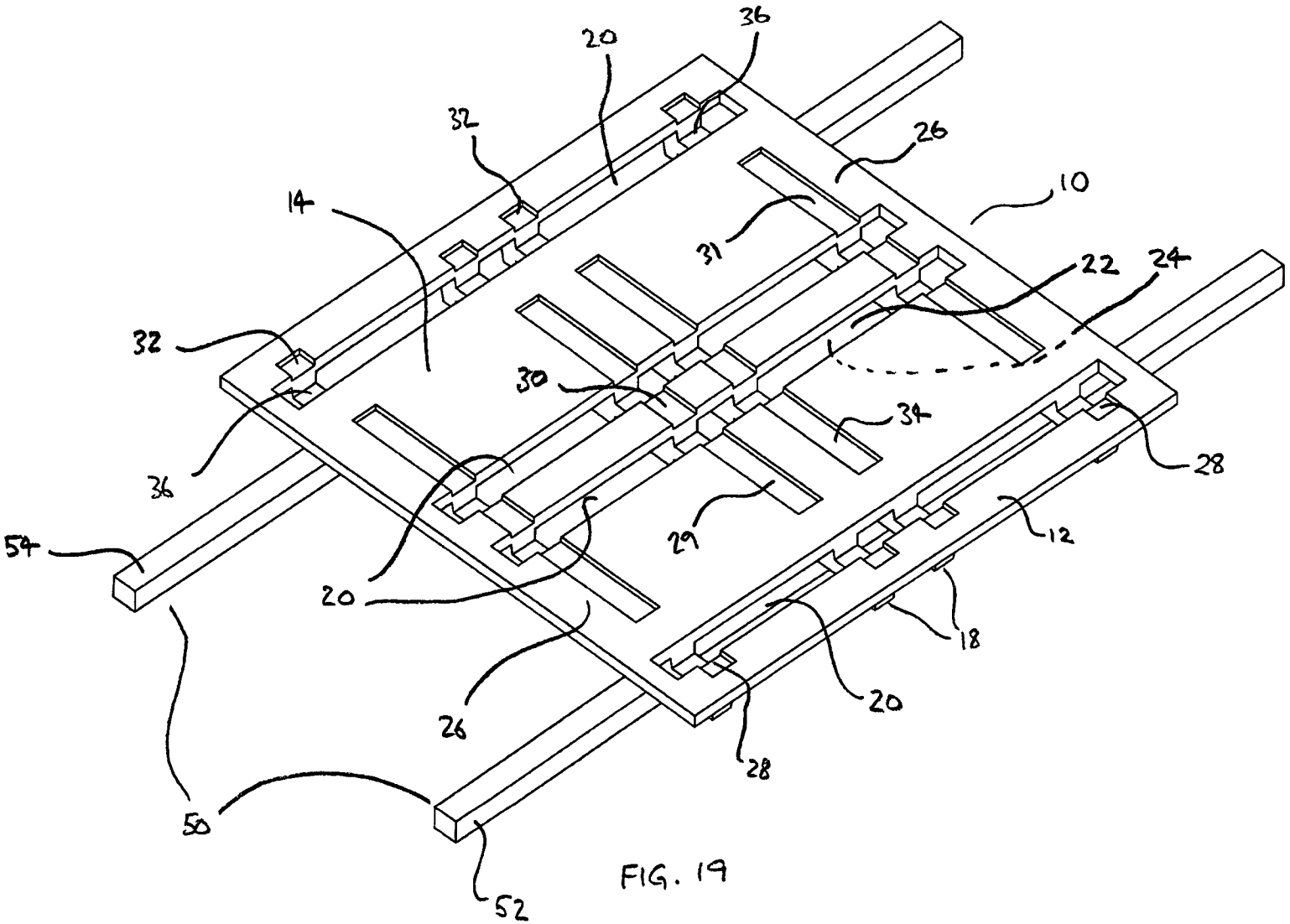
FIG. 19 is a top perspective view of a pallet in accordance with an embodiment of the present invention, the pallet resting on a standard beam racking system (a first type rack)
Figure 20:
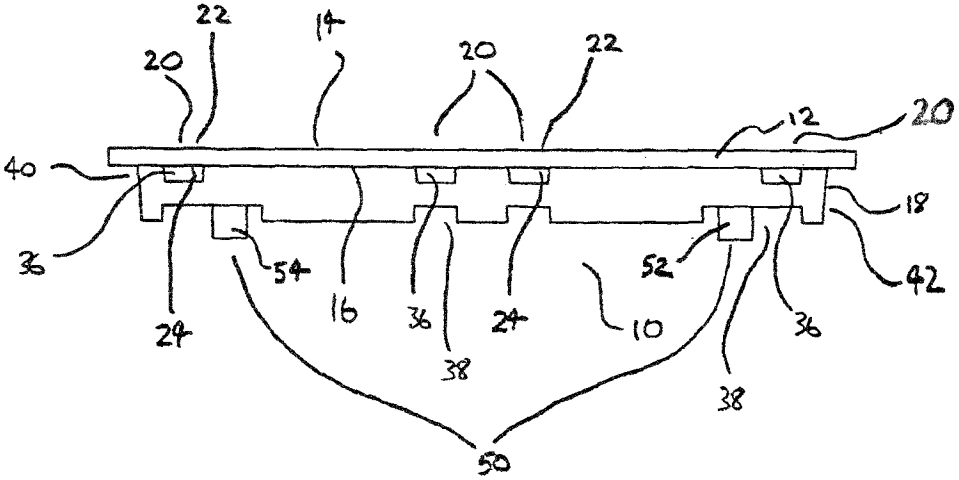
FIG. 20 shows the pallet on the standard beam racking system, as shown in FIG. 19.

FIGS. 19 and 20 show an alternative racking system, sometimes known as a standard beam racking 50 (for the purposes of this specification, the standard beam racking is sometimes described and/or defined as a "first type rack").

The standard beam rack 50 includes a first beam 52 and a second beam 54. The separation between the first and second beams 52, 54 is less than the separation in the drive-in racking beams 46 and 48.

As can be seen, perhaps more clearly, in FIG. 20, when the pallet 10 is used with the standard beam racking 50, the support members 18 of the pallet rest on the beams 52 and 54. In the embodiment of the present invention shown in FIG. 20, the support member 18 one of (which can be seen in FIG. 20) includes two lower recesses 38, located toward opposite ends of the support member 18, where those lower recesses are wider than the inner-most lower recesses 38 in the support member. In this way, when the pallet 10 rests on the first and second beams 52 and 54 of the standard beam rack 50, the beams are received in the wide lower recesses 38. Accordingly, as would be readily understood by a person skilled in the art, movement of the pallet in a direction orthogonal to the longitudinal axis of the beams 52, 54 is substantially prevented or ameliorated. The substantial prevention or amelioration of orthogonal movement ensures that, when the pallet 10 is placed on the standard beam racking 50 the pallet will not readily slide off the rack.

Further, because the pallet 10 rests on the standard beam racking 50 using the support members 18, it will be appreciated that there is a gap between the lower face 16 of the pallet and the upper faces of the beams 52 and 54. It is possible to insert tines of a forklift device under the body 12 of the pallet 10 when the pallet is resting on such standard beam racking 50.

Figure 21:
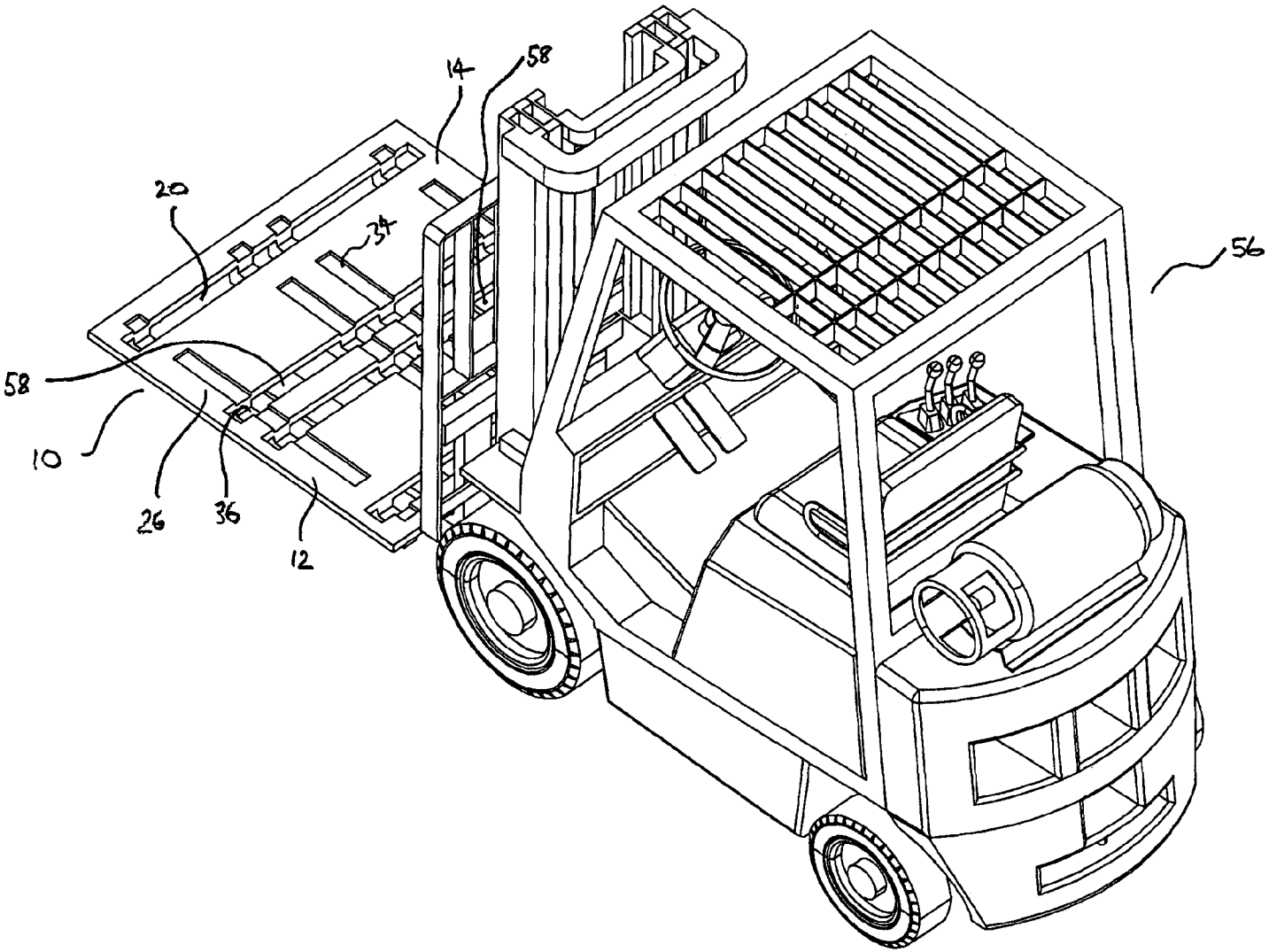
FIG. 21 is a top perspective view of a forklift operating with a pallet in accordance with an embodiment of the present invention.

FIG. 21 shows a forklift operating with an embodiment of the present invention. The forklift 56 has two forklift tines 58 which are inserted under the body 12 of the pallet 10. The forklift tines 58 fit into gaps between each of the outermost support members 18 of the pallet 10 and the inner most support members 18 of the pallet. It will be appreciated that the forklift 56 can operate with the pallet 10 when the pallet is loaded with goods for transportation, or when the pallet is empty.

In embodiments of the present invention, the pallet 10 may be formed such that, when stacking in the rotated stacking configuration, there is a 3:2 ratio of the height of a single pallet. In this regard, when three pallets are stacked in the rotated stacking configuration, the height of the three stacked pallets would be approximately equal to twice the height of a single pallet. In this way, the present invention may achieve return logistics savings by minimising the use of the vehicle transport space when re-locating empty pallets.

When using the non-rotated stacking configuration, users and handlers may operate the pallet in a manner similar to other prior art pallets, which have both upper and lower decks. In this way, users and handlers would require relatively little retraining to use the pallets of the present invention. Further, by allowing the non-rotated stacking configuration, the pallets should not require more load and unload time for forklift operators, as compared with use of prior art pallets.

In an embodiment, the pallet of the present invention may be used with various handling devices such that adjustable forklift tines, non-adjustable tines and various hand trolleys.

Moreover, the pallet may be produced so as to be light enough, when empty and not carrying goods, that the pallet may be stacked, or re-positioned by hand, without the use of such devices as forklifts.

In some embodiments, the pallet may be formed from plastic or wood. Where the pallet is formed from plastic, the pallet may also include hollow sections in the support members and/or the body, so as to reduce the amount of material used in creating the pallet, and also reducing the overall weight of the pallet.

It is envisaged that, where a pallet is created from wood, there would not be hollow section or voids in the body and/or support members of the pallet.

Further, a pallet in accordance with the present invention may be formed of other materials such as metal, again to reduce the amount of material used in making the pallet, and to lighten the pallet, where the pallet is created from metal the body and/or the support members may include hollows or voids.

In the embodiment of the pallet described in the present specification, the pallet includes four support members. When the pallet is used with a standard beam racking system, the four support members provide eight contact points, which allows weight on the pallet to be distributed over those eight contact points.

Where the pallet is formed from plastic, and the support members include hollows or voids, such hollows or voids may also include ribbing to provide extra support and strength to the support members. The ribbing may extend from the bottom of the support member up to the top of the support member, where the support member joins with the lower face of the body of the pallet.

Further, where the pallet is configured as described in the present specification, when resting on the ground, there are twenty contact points between the pallet and the ground, which provides strength, especially when the pallet is loaded with goods for transport.

A further feature of the present invention is that, when the pallet is used with drive-in racking, the support members provide reinforcement of the body of the pallet so as to prevent morphing of the pallet whilst on the drive-in racking system.

The strengthened design of the pallet, using the support members, may assist in preventing or ameliorating morphage of the pallet and/or the pallet body, when the pallet is stacked or on racks for extended periods.

The pallet may also include "X"-shaped ribs on the lower face so as to provide additional strength to the body.

The present invention is susceptible to variations, modifications and/or additions other than those specifically described, and it is to be understood that the invention includes all such variations, modifications and/or additions which fall within the scope of the following claims.

The reference to any prior art in this specification is not and should not be taken as an acknowledgement or any form of suggestion that the prior art forms part of the common general knowledge.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The invention claimed is:

1. A stackable pallet for use in transportation of goods and for stacking in a rotated stacking configuration with at least one second substantially same stackable pallet, the first-mentioned stackable pallet comprising:

a substantially planar body having an upper face and a lower face;

a plurality of substantially parallel elongate support members depending from the lower face;

a plurality of substantially parallel elongate slots, each slot open to at least the upper face, wherein the longitudinal axis of the slots are substantially orthogonal to the longitudinal axis of the support members, and wherein each slot is configured to receive a respective one of the plurality of support members of the second stackable pallet, such that, when stacking the second pallet on to the first-mentioned pallet in the rotated stacking configuration, the support members and slots of the second pallet are, respectively, substantially orthogonal to the support members and slots of the first-mentioned pallet and wherein the slots are through the body, such that each slot is further open to the lower face, and wherein each slot is configured to allow a lower portion of each of the plurality of support members of the second stackable pallet to pass through the lower face opening when stacking the second pallet on to the first-mentioned pallet in the rotated stacking configuration, further including an upper recess corresponding to where each slot intersects with each support member, each upper recess located in an upper portion of the respective support member and being open to the respective slot, such that, when stacking the second pallet on to the first-mentioned pallet in the rotated stacking configuration, a part of the lower portion of the respective one of the plurality of support members of the second stackable pallet is received in a respective upper recess of the first-mentioned pallet.

2. A stackable pallet according to claim 1, wherein each slot is configured to allow substantially the whole of each of the plurality of support members of the second stackable pallet to pass through the upper face opening of each respective slot when stacking the second pallet on to the first-mentioned pallet in the rotated stacking configuration, such that, when stacked, the lower face of the second pallet is adjacent or very near the upper face of the first-mentioned pallet.

3. A stackable pallet according to claim 1, further including a lower recess corresponding to where each slot intersects with each support member, each lower recess located in the lower portion of the respective support member and being open to a bottom face of the respective support member, such that, when stacking the second pallet on to the first-mentioned pallet in the rotated stacking configuration, a part of an upper portion of the respective one of the plurality of support members of the first-mentioned pallet is received in a respective lower recess of the second pallet.

4. A stackable pallet according to claim 1, further including a lower recess corresponding to each upper recess in the respective support member, and located below the corresponding upper recess, the lower recess located in the lower portion of the respective support member and being open to a bottom face of the respective support member, such that, when stacking the second pallet on to the first-mentioned pallet in the rotated stacking configuration, an upper recess of the first-mentioned pallet and a respective lower recess of the second pallet receive each other.

5. A stackable pallet according to claim 1, wherein each support member includes hollow sections.

6. A stackable pallet according to claim 5, wherein at least some of the hollow sections are open to the upper face.

7. A stackable pallet according to claim 5, wherein at least some of the hollow sections are open to the bottom face of the respective support member.

8. A stackable pallet according to claim 1, wherein the support members are configured such that tines of a fork lift device are able to be inserted beneath the lower face so as to be between and in a first direction substantially parallel to the support members, and the tines are not able to be inserted in a direction substantially other than the first direction.

9. A stackable pallet according to claim 1, wherein the pallet is adapted to be used with a first type rack having parallel bars with a first separation between the bars, such that, when the pallet is located on the first type rack, the support members are substantially orthogonal to the bars and are configured such that a section of each support member is in contact with each bar.

10. A stackable pallet according to claim 9, wherein each support member has a height sufficient to allow tines of a fork lift device to be inserted beneath the lower face when the pallet is located on the first type rack.

11. A stackable pallet according to claim 9, wherein each section includes a rack recess in the respective support member, such that, when the pallet is located on the first type rack, each bar inserts in to a plurality of respective rack recesses, such that the pallet is prevented from sliding orthogonally with respect to the bars.

12. A stackable pallet according to claim 11, wherein each rack recess is sufficiently shallow to allow tines of a fork lift to be inserted beneath the lower face when the pallet is located on the first type rack.

13. A stackable pallet according to claim 11, wherein each rack recess is at least partly co-located with a lower recess.

14. A stackable pallet according claim 9, wherein the pallet is adapted to be used with a second type rack having parallel bars with a second separation between the bars, such that, when the pallet is located on the second type rack, the support members are substantially parallel to the bars and parts of the lower face is in contact with each bar, each part being at or close to an edge of the body.

15. A stackable pallet according to claim 14, wherein the first separation is less than the second separation.

16. A stackable pallet according to claim 1, wherein the plurality of support members includes, adjacently, a first, a second, a third and a fourth support member.

17. A stackable pallet according to claim 16, wherein the first and the fourth support members are located close to and parallel to respective outside edges of the body and the second and the third support member are located close to and parallel to a centre line of the body, such that a first and a second tine of a fork lift device are able to be inserted, respectively, between the first and second, and between the third and fourth support members.

18. A stackable pallet according to claim 1, having a pallet height, wherein, when the second pallet is stacked on to the first-mentioned pallet in the rotated stacking configuration, the stacked pallets have a sum height less than twice the pallet height.

19. A stackable pallet according to claim 1, further including a plurality of substantially parallel elongate channels in the upper face to allow for stacking in a non-rotated stacking configuration, wherein the longitudinal axis of the channels are substantially parallel to the longitudinal axis of the support members, and wherein each channel is configured to receive a respective one of a plurality of support members of the second stackable pallet, such that, when stacking the second pallet on to the first-mentioned pallet in the non-rotated stacking configuration, the support members and channels of the second pallet are substantially parallel to the support members and channels of the first-mentioned pallet.

20. A stackable pallet according to claim 19, wherein, each support member is configured to be sufficiently high and each channel is configured to be sufficiently shallow, such that, when the second pallet is stacked on to the first-mentioned pallet in the non-rotated stacking configuration, tines of a fork lift device are allowed to be inserted between the lower face of the second pallet and the upper face of the first-mentioned pallet.

21. A stackable pallet according to claim 19, wherein each channel includes a plurality of channel sections, each channel section separated from an adjacent channel section where the channel intersects a slot.

22. A method of stacking a plurality of pallets, each pallet according to claim 19, comprising the steps of:

stacking a first pallet; and stacking at least a second pallet relative to the first pallet, wherein the pallets are stacked using the non-rotated stacking configuration.

23. A method of transporting goods, comprising the steps of:

locating the goods on a pallet according to claim 1; and transporting the goods using the pallet.

24. A method of stacking a plurality of pallets, each pallet according to claim 1, comprising the steps of:

stacking a first pallet; and stacking at least a second pallet relative to the first pallet, wherein the pallets are stacked using the rotated stacking configuration.

* * * * *